US005747210A

United States Patent [19]

Emoto et al.

[11] Patent Number: 5,747,210

[45] Date of Patent: May 5, 1998

[54] ELECTROSTATIC IMAGE DEVELOPING TONER AND METHOD FOR PRODUCING THE TONER

[75] Inventors: Shigeru Emoto; Kumi Hasegawa; Youichi Maekawa; Kazuhito Watanabe; Kouki Katoh, all of Numazu, Japan

[73] Assignee: Ricoh Company, Ltd., Tokyo, Japan

[21] Appl. No.: 703,402

[22] Filed: Aug. 26, 1996

[30] Foreign Application Priority Data

Aug. 24, 1995 [JP] Japan ..... 7-239237
Jan. 11, 1996 [JP] Japan ..... 8-020563

[51] Int. Cl.[6] ..... G03G 9/087

[52] U.S. Cl. ..... 430/109; 430/137

[58] Field of Search ..... 430/106, 109, 430/137

[56] References Cited

U.S. PATENT DOCUMENTS

| | | | |
|---|---|---|---|
| 5,015,724 | 5/1991 | Kawabe | 430/109 |
| 5,057,392 | 10/1991 | McCabe et al. | 430/109 |
| 5,294,682 | 3/1994 | Fukuda et al. | 430/109 |

*Primary Examiner*—John Goodrow
*Attorney, Agent, or Firm*—Oblon, Spivak, McClelland, Maier & Neustadt, P.C.

[57] ABSTRACT

An electrostatic image developing toner containing a polyester binder resin in which an oxyalkylether of a novolak phenol resin is crosslinked with polycarboxyl groups and contains 5 to 20% by weight of components having a weight-average molecular weight greater than about $1\times10^7$ and is essentially free of a tetrahydrofuran-insoluble portion.

20 Claims, No Drawings

ELECTROSTATIC IMAGE DEVELOPING TONER AND METHOD FOR PRODUCING THE TONER

BACKGROUND OF THE INVENTION

1. Field of the Invention

The present invention is directed to a developing toner for electrostatic image formation which contains coloring agents dispersed in a polyester binder resin and is useful for electrophotographic reproduction and printing with a hot-roll fixing unit. The invention is also directed to a method of producing the developing toner.

2. Description of the Related Art

The electrostatic image forming process used in electrophotographic reproduction and printing is well-known. In the usual form of electrostatic photocopying, an optical image of an original document is applied to a uniformly charged photoreceptor, causing the plate to discharge in those areas which are exposed to light, which results in an electrostatic latent image of the document on the photoreceptor (see *Kirk-Othmer Encyclopedia of Chemical Technology*, Fourth Edition, Volume 9, Wiley-Interscience, New York, 1996, pp. 245–277, incorporated herein by reference). This latent image is then developed into a visible image with a toner. Toner particles are transferred to a receiving copy sheet and are fixed onto the copy sheet by fusing to form a permanent copy of the original document.

In order to satisfy recent demands for higher photocopying speed and lower energy consumption, the toner must be manufactured with uniformity and sufficient mechanical strength to withstand constant impacts against the photoreceptor and other parts of a photocopying machine. Also, the toner must soften on exposure to heat and/or pressure with a minimum amount of energy from the fixing unit of the photocopier.

The toner generally contains toner particles, where each toner particle contains a binder resin, e.g., a synthetic polymer, and a coloring agent, e.g., carbon black, dispersed in the binder resin.

In an electrophotographic reproduction machine using a hot-roll fusing unit, the toner is subjected to melting in contact with the surface of the roller under pressure during the fusing process. One problem in the fusing process is paper offset or hot offset, where parts of the toner image are transferred to the hot roller to form images on the copy sheet, resulting in undesirable blur of the copied image.

In order to prevent hot offset, a toner binder resin containing a crosslinked copolymer have been disclosed (Japanese Patent No.51-23354). Although this toner has improved hot offset and/or abrasion resistance, this toner does not exhibit satisfactory image-fixing characteristics.

A novolak phenol resin has been disclosed to enhance low temperature fixing capability and hot offset resistance. Although this resin has the desired low temperature fixing capability, it is not satisfactory with regard to hot offset resistance. As a result of its relatively low hot offset resistance, this resin has a narrow fusing latitude, i.e., the temperature difference between image fixing and hot offset.

In hot-roll fusing, attempts have been made to prevent the build-up of melted toner on the hot roller. The surface of the fixing roller can be made with such materials as fluorinated resin which has a satisfactory releasing property for toner particles and further supplies coating liquid such as silicone oil onto the surface. Although this method is quite effective for preventing hot offset, the coated liquid tends to release unacceptable odors and fumes when heated. In addition, this resin requires an additional unit for supplying the coating liquid, which results in a more complicated design and higher cost for the photocopier.

There are two known two methods of electrostatic image development. One is the two component development which has been described above. The other method is known as single or mono-component development.

A magnetic toner is used in the single development method which generally contains magnetic particles which do not easily melt by heat. Therefore, when this magnetic toner is used in the hot-roll fusing, especially with low temperature fixing, poor quality copies are obtained. In addition, the magnetic particles are relatively hard and some of the particles are exposed on the outer face of the toner. When magnetic-blush development is carried out with the magnetic toner, the exposed hard portion of the toner particles may form abrasion streaks on the surface of the photoreceptor causes roughness in the reproduced image. The number streaks generally increases with an increasing number of imaging cycles and the toners are often embedded onto these streaks. This results in insufficient cleaning of the residual toner particles during the cleaning process. In addition, these abrasion streaks are formed on the surface of photoreceptors of organic photoconductors easily, which adversely affects copy quality.

In electrostatic reproduction machines using a hot-roll fusing unit, eliminating the hot offset by improving the toner characteristics is a major challenge because reproduction machines of higher copying speed and yet lower power consumption place additional physical and chemical requirements on the toner particles.

As noted above, the polymeric binder resin in the toner particles needs sufficient mechanical strength to withstand constant impacts and abrasion in the developing unit and also must acquire enough fluidity when melted at elevated temperatures. However, in order to acquire enough fluidity, the toner has to be heated to high temperatures which requires a large amount of energy, in contrast to the above-noted requirement for using less energy. To satisfy the requirement for lower energy consumption, the toner particles should be fixed at temperatures which are as low as possible. Although binder resins with relatively low glass transition temperatures and low molecular weights may be favored from a mechanical and rheological property point of view, the existing binder resins are generally insufficient in their strength and tend to cause the undesired hot offset.

In order to impart sufficient strength to toner particles, thereby preventing the hot offset, polymer materials of average molecular weight of about $1\times10^5$ or greater are conventionally used, with vinyl polymers particularly preferred. With vinyl polymers of high molecular weight, toner fixing at relatively low temperatures is achieved by (1) lowering the glass transition temperature of the vinyl polymer as low as possible, to such an extent not to cause blocking, or (2) lowering the fixing temperature by the addition of elastomers. These methods, however, decrease the fixing temperature, i.e., the lowest temperature at which image fixing is completed and also decrease hot offset temperature i.e., the temperature at which the hot offset is initiated. This results in only a downward shift of the window of acceptable operating temperature, the fusing latitude, which is the difference between these two temperatures. Lowering the hot offset temperature is not favored from a practical point of view.

One approach for preventing a decrease in the hot offset temperature is to increase the weight-average molecular weight of the polymer. However, decreases the viscosity of the polymer and leads to a higher glass transition temperature and image fixing temperature. Also, increasing the amount of crosslinked material in the resin makes the polymer more difficult to pulverize.

In contrast, polyester resin has a relatively low class transition temperature and is easily obtained as a low molecular weight material. This material is also suitable for low temperature fixing. In practice, however, low molecular weight polyester resin tends to cause hot offset and is generally not compatible with hot-roll fusing.

As noted above, vinyl polymers have relatively high offset temperatures and polyester resins are generally suitable for low temperature fixing. Blending these two polymers has been carried out to take advantage of these two properties, as disclosed in Japanese Laid-Open Patent Application 54-114245. The resulting blended polymer has an inhomogeneous structure, probably due to the relatively low miscibility of the component polymers. As the difference in the molecular weights increases between these two polymers, the miscibility decreases. This poor miscibility likely causes in the inhomogeneous structure noted above, as previously observed with blended plastic materials of low miscibility using a phase difference microscope and reported as an island model in *Plastics* 13, (9), 1962, page 1.

Additional components may be dispersed in this binder resin, such as polarity control agent, dyes, pigments, coloring agents and magnetic materials. The distribution of these additional components becomes uneven over the volume of resin material. This uneven distribution can cause reverse charging of the toner which produces a fog in the copied image.

In order to improve the miscibility between a polyester polymer and a vinyl polymer, a grafted copolymer containing segments of these two polymers has been prepared. However, the graft copolymer does not retain the advantageous properties of each individual polymer.

SUMMARY OF THE INVENTION

Accordingly, one object of the present invention is to provide an electrostatic image developing toner which overcomes the difficulties noted above.

A further object of the present invention is to provide an electrostatic image developing toner containing toner particles which has enhanced low temperature image fixing and improved hot offset resistance.

These and other objects of the present invention have been satisfied by the discovery of an electrostatic image developing toner containing a polyester binder resin and at least one coloring agent dispersed in the binder resin.

The present invention polyester binder resin contains at least one polyol crosslinked with at least one polycarboxyl group, where at least one of the polyols is an oxyalkylether of a novolak phenol resin. Preferably, the polyester binder resin (1) is essentially free of a tetrahydrofuran-insoluble portion and (2) contains from 5 to 20% by weight of components having a weight-average molecular weight greater than about $1\times10^7$.

In one embodiment of the present invention, the polyester binder resin has a main peak of molecular weight distribution of from 2000 to 10000 and contains from 50 to 70% weight of components having a weight-average molecular weight up to about 10000.

In another embodiment, the binder resin has a glass transition temperature of from 50° C. to 65° C., an acid value of from 1 to 5 mg KOH/g, and a hydroxy radical value of from 30 to 80 mg KOH/g.

In yet another embodiment, the binder resin has the percentage of water content of about 3000 ppm or less after 24 hours at a temperature of 30° C. temperature and 60% humidity.

In still another embodiment, the electrostatic image developing toner further contains wax, where the wax is dispersed in the toner as particles having a diameter of up to about 2 microns.

In another embodiment, the electrostatic image developing toner contains magnetic particles having a diameter of less than 0.1 microns.

In yet another embodiment, the electrostatic image developing toner has a softening temperature of from 70° C. to 85° C. and a lowest fluidity temperature of from 115° C. to 135° C.

In one embodiment, the polyester binder resin can be prepared by polymerizing at least one polycarboxylic acid or anhydride and at least one polyol, where at least one polyol is an oxyalkylether of a novolak phenol resin. The polyol is selected so that the binder resin (1) is essentially free of a tetrahydrofuran-insoluble portion and (2) contains components of weight-average molecular weight of about $1\times10^7$ or greater in an amount of from 5 to 20% by weight.

These and other objects, features and advantages of the present invention will become apparent upon a consideration of the following description of the preferred embodiments of the invention.

DESCRIPTION OF THE PREFERRED EMBODIMENTS

In the detailed description which follows, specific embodiments of the invention particularly useful in electrophotographic reproduction are described. It is understood, however, that the invention is not limited to these embodiments. For example, the image developing toner and methods of the invention are adaptable to any form of electrostatic image formation. Other embodiments will be apparent to those skilled in the art upon reading the following description and the appended claims.

The invention provides an electrostatic image developing toner containing toner particles formed from a polyester binder resin and at least one coloring agent dispersed in the binder resin.

The present invention polyester binder resin contains at least one oxyalkylether of a novolak phenol resin crosslinked with at least one polycarboxyl group. Preferably, the polyester binder resin (1) is essentially free a tetrahydrofuran-insoluble portion and (2) contains from 5 to 20% by weight of components having a weight-average molecular weight greater than about $1\times10^7$.

The term "essentially free" means that polyester binder of the present invention resin may a contain a minor amount of a tetrahydrofuran-insoluble portion, i.e., an amount that does not adversely affect the function of the resin in the toner.

Preferably, the minor amount of the tetrahydrofuran-insoluble portion does not increase the amount of components having a weight-average molecular weight greater than about $1\times10^7$ to a value greater than 20% by weight. It is also preferred that the polyester binder resin containing a minor amount of the tetrahydrofuran-insoluble portion has a main peak of weight-average molecular weight distribution of from 2000 to 10000 and contains from 50 to 70% by weight of components having a weight-average molecular weight up to about 10000. It is also preferred that the polyester binder resin containing a minor amount of the tetrahydrofuran-insoluble portion has a softening temperature of from 70° C. to 85° C. and a lowest fluidity temperature of from 115° C. to 135° C.

Unless otherwise specified, all molecular weights disclosed herein are weight-average molecular weights.

An oxyalkylether of a novolak phenol resin is, for example, the reaction product of novolak phenol resin and a compound which contains one epoxy ring or a monohydric alcohol, as discussed below.

A novolak phenol resin is the product of a polycondensation reaction of a phenol and an aldehyde, generally carried out with strong acid or alkaline catalysts. More than one phenol or aldehyde may be used. Specific examples of acid catalysts are inorganic acids, such as hydrochloric acid, phosphoric acid and sulfonic acid, and organic acids, such as p-toluene sulfonic acid and oxalic acid. Novolak phenol resins and methods of making the same are well-known, see *Kirk-Othmer Encyclopedia of Chemical Technology*, Fourth Edition, Volume 18, Wiley-Interscience, New York, 1996, pp. 603–644, incorporated herein by reference.

Suitable phenols for preparing the novolak phenol resins include phenol and substituted phenols which have hydrocarbon radicals of from 1 to 35 carbon atoms and/or one or more halogen radicals.

Substituted phenols include ortho, meta or para-cresol, ethyl phenol, nonyl phenol, octyl phenol, phenyl phenol, styrenated phenol, isopropenyl phenol, 3-chlorophenol, 3-bromophenol, 3,5-xylenol, 2,4-xylenol, 2,6-xylenol, 3,5-dichlorophenol, 2,4-dichlorophenol, 3-chloro-5-methyl phenol, dichloroxylenol, dibromoxylenol, 2,4,5-trichlorophenol, and 6-phenyl-2-chlorophenol.

Mixtures of phenols may be used. Phenols and substituted phenols having hydrocarbon radicals of from one to 35 carbon atoms are preferably employed, with phenol, cresol, t-butyl phenol and nonyl phenol most preferred.

Phenol and cresol are preferred for their low cost and hot offset resistance. Substituted phenols such as t-butylphenol and nonyl phenol, are preferred for their capability of reducing the temperature dependence of the charge stability of the toner.

Suitable aldehydes for preparing the novolak phenol resins include formalin, paraformaldehyde, trioxane, and hexamethylenetetramine.

The number average-molecular weight distribution of the novolak phenol resin is preferably from 300 to 8000, more preferably from 450 to 3000, and most preferably from 450 to 2000.

The number-averaged nuclide number of the novolak phenol resin is from 3 to 60, preferably from 3 to 20, and more preferably from 4 to 15.

The softening temperature of the resin, measured with the ring and ball method (JIS K2531), is preferably from 40° C. to 180° C., more preferably from 40° C. to 150° C., and most preferably from 50° C. to 130° C. When the softening temperature of the resin is 40° C. or below, the resin is difficult to handle due to blocking. A softening temperature greater than 180° C. is not desired because gelation occurs during resin manufacturing.

Compounds (b) which contain one epoxide functionality and are suitable for preparing the oxyalkylether of a novolak phenol resin, include ethylene oxide (EO), 1,2-propylene oxide (PO), 1,2-butylene oxide, 2,3-butylene oxide, styrene oxide, and epichlorohydrin. Also preferred are aliphatic monohydric alcohols having 1 to 20 carbon atoms and glycidyl ethers of monohydric phenols. Ethylene oxide and/or propylene oxide are most preferred in the present invention.

The average mole number of the compound (b), to one mole of the novolak phenol resin to form the oxyalkyl ether of the novolak phenol resin, is generally from 1 to 30, preferably from two to 15, and more preferably from 2.5 to 10. In addition, the average mole number of the compound (b), to one hydroxy radical in the phenol resin, is generally from 0.1 to 10, preferably from 0.1 to 4, and more preferably from 0.2 to 2.

The number-average molecular weight of the oxyalkylene ether of the novolak phenol resin is preferably from 300 to 10000, more preferably from 350 to 5000, and most preferably from 400 to 3000. Satisfactory hot offset resistance is not achieved when the molecular weight of the oxyalkylene ether is about 300 or less and gelation of the polyester resin during manufacture occurs when the molecular weight is greater than 10000, which are both undesirable.

The hydroxy radical value, i.e., the sum of the number of alkyl alcoholic radicals and phenolic hydroxy radicals, is generally from 10 to 550 mg KOH/g, preferably from 50 to 500 mg KOH/g, and more preferably from 100 to 450 mg KOH/g. The value of phenolic hydroxy radical is from 0 to 500 mg KOH/g, preferably from 0 to 350 mg KOH/g and more preferably from 5 to 250 mg KOH/g.

Suitable oxyalkylethers of novolak phenol resins for use in the present invention polyester binder resin include polyoxypropylene(2,2)-2,2-bis(4-hydroxyphenyl)propane, polyoxypropylene(2,3)-2,2-bis(4-hydroxyphenyl)propane, polyoxyethylene-propylene-bis(4-hydroxyphenyl)methane and polyoxypropylene(3,1)-2,2-bis(4-hydroxyphenyl) propane.

One method for producing an oxyalkylene ether of a novolak phenol resin is an addition reaction of a novolak phenol resin with an epoxide-containing compound, with either basic or acidic catalysis. The reaction temperature for this reaction is preferably from 20° C. to 250° C., and more preferably from 70° C. to 200° C. under normal, high or reduced pressure. The reaction is carried out in any suitable solvent, such as xylene or dimethylformamide, a dihydroxylic alcohol and/or another alcohol having three or more hydroxyl groups.

The polycarboxyl groups which crosslink the oxyalkylether of a novolak phenol resin in the present invention are formally derived from polycarboxylic acids. In other words, the -OH moiety of each carboxylic acid involved in a crosslink has been removed and replaced with an ester linkage to any alcohol moiety of the oxyalkylether of a novolak phenol resin. The alcohol moiety may be a phenolic alcohol or an alkyl alcohol, for example. Accordingly, the hydrogen atom of an alcohol group of a novolak phenol resin which is crosslinked with a polycarboxyl group is not present in the polyester resin.

It is explicitly noted, however, that the present invention polyester resin is not limited to the polymerization of oxyalkylethers of novolak phenol resins with polycarboxylic acids. Any type of activated carboxylic acid derivative may be used, such as anhydrides, acid halides, esters, and lactones. Carboxylic acids and anhydrides are particularly preferred.

The oxyalkylether of a novolak phenol resin component of the present invention polyester binder resin is selected such that the binder resin in the toner (1) is essentially free of a tetrahydrofuran-insoluble portion and (2) contains 5 to 20% by weight of components with a weight-average molecular weight greater than about $1\times10^7$.

The present invention polyester binder resin can be the product of a polymerization reaction of at least one polycarboxylic acid or anhydride and at least one polyol, where one polyol is an oxyalkylether of a novolak phenol resin.

In one embodiment, the weight-average molecular weight distribution of the polyester binder resin has a main peak of from 2000 to 10000 and contains from 50% to 70% weight % of components having a weight-average molecular weight up to about 10000, which improves the shear mixing and low-temperature image fixing qualities of the resin.

The polyester resin is generally susceptible to environmental conditions such as humidity. In the present invention, improving resin durability, as well as low temperature image fixing, was achieved by (1) incorporating an oxyalkylether of a novolak phenol resin into the polyester, rendering it less susceptible to humidity, (2) adjusting the glass transition temperature of the resin to from 50° C. to 65° C. and (3) reducing the acid and hydroxy radical value of the resin to 1 to 5 mg KOH/g and from 30 to 80 mg KOH/g, respectively. Also, the charge stability of the binder resin at high temperature is improved by reducing the water content of the binder resin to about 5000 ppm or less, more preferably about 3000 ppm or less.

The binder resin can additionally contain wax as a releasing agent in order to improve the hot offset resistance. The diameter of the wax particles dispersed in the binder resin is preferably about 2 microns or less. This reduces the amount of carrier materials spent during the developing process and also improves electrostatic charging.

In addition, magnetic particles having the diameter of about 0.1 microns or less can be included in the binder resin to improve cleaning efficiency.

The hot offset resistance is also improved by extending the temperature range of image fixing. This temperature range is the difference between the image fixing temperature and the hot offset temperature. This improvement is achieved by selecting shear mixing conditions such that an appropriate binder resin fluidity initiation temperature is attained during manufacture of the toner.

The temperature range of the image fixing can be measured with a flow tester. The temperatures of softening and fluidity initiation are preferably from 70° C. to 85° C. and from 115° C. to 135° C., respectively.

As noted above, the amounts of the tetrahydrofuran-insoluble, i.e., crosslinked, and tetrahydrofuran-soluble portions in the binder resin are particularly important. By using proper amounts of these portions during manufacture of the resin, toner characteristics such as image fixing, shear mixing and hot offset have been appropriately adjusted and balanced.

The amount of the tetrahydrofuran-soluble and insoluble portions is determined by (1) dissolving the binder resin into solvent such as tetrahydrofuran, (2) separating the tetrahydrofuran-soluble and insoluble portion, and (3) measuring molecular weight of the soluble portion by a gel permeation chromatography method, as described below. These results are then correlated to image fixing, shear mixing and hot offset.

The tetrahydrofuran-insoluble portion has an adverse effect on image fixing and a favorable effect on hot offset. With an excess of the tetrahydrofuran-insoluble portion, several problems arise during manufacturing, e.g., an excessive mechanical load on the shear mixer during toner mixing, for example. This results in a decrease in toner mixing and, accordingly, a toner of lower quality.

Upon close examination of the molecular weight distribution of the present invention binder resin and its correlation with toner performance, we have found that electrostatic image developing toners containing the present invention polyester resin have excellent image developing characteristics and humidity resistance, as described below.

The gel permeation chromatography (GPC) method used to measure weight-average molecular weights disclosed herein is described below.

A GPC column is placed in a temperature controlled chamber and stabilized at 40° C. temperature with tetrahydrofuran as the eluant at a flowrate of 1 ml/min. A sample solution of resin in tetrahydrofuran is prepared with a concentration of from 0.05 to 0.6% by weight. The sample solution is then injected onto the column in a volume from 50 to 200 μl. The molecular weight of the resin sample is obtained by comparison to values for various resin standards, such as mono-disperse polystyrene.

As standards, polystyrene samples with molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $1\times10^6$ and $4.48\times10^6$, available from Pressure Chemical Co. or Toyo Soda Co. are suitable. At least ten or more values for the standard samples are preferably obtained for calibration of the chromatograph. For the measurements, a refractive-index type of the detector is generally used. It is difficult to determine the molecular weight of about $1\times10^7$ or greater with currently available GPC columns.

In addition, it has been found experimentally that microgels are present in the tetrahydrofuran-soluble portion, which have a components of molecular weight greater than about $1\times10^7$. These microgels influence binder resin properties such as fixing, shear mixing and hot offset.

The amount of microgel in the tetrahydrofuran-soluble portion can be determined by (1) gradually adding a solvent which does not dissolve the toner to the tetrahydrofuran, and (2) correlating the ratio of the amount of the added solvent to the amount of tetrahydrofuran, to the molecular weight distribution.

In the present invention, the above-mentioned ratio of microgels is measured at 25° C., using a solution of isododecane in tetrahydrofuran, such that the volume ratio of tetrahydrofuran to isododecane is preferably (2±0.5)/(3±1.5). When the toner is dissolved in the tetrahydrofuran/isododecane solution, the molecular weight value from gel permeation chromatography is obtained and correlated to the molecular weight of microgels in the range of above $1\times10^7$.

For the tetrahydrofuran-insoluble portion the separation and measurement can be carried out as follows. (1) Approximately 1.0 g of toner is weighed, dissolved into about 50 g of tetrahydrofuran and left unstirred for 24 hours at 20° C. (2) The solution is then separated with a centrifugal separator and filtered at room temperature using a filter paper (JIS(P3801)5C). The weight of this tetrahydrofuran-insoluble residue on the filter paper is recorded. (3) Carbon and other solid materials are present in this residue, which can be further analyzed by thermal analysis methods, for example.

Suitable examples of polycarboxylic acids useful for preparing the polyester binder resin include dicarboxylic acids and polycarboxylic acids having three or more carboxyl groups.

Suitable dicarboxylic acids include (1) aliphatic dicarboxylic acids having from 2 to 20 of carbon atoms, such as fumaric acid, succinic acid, adipic acid, sebacic acid, malonic acid, azelaic acid, mesaconic acid, citraconic acid, and glutaconic acid; (2) cyclic dicarboxylic acids having from 8 to 20 of carbon atoms, such as cyclohexane dicarboxylic acids; (3) aromatic dicarboxylic acids having from 8 to 20 of carbon atoms, such as phthalic acid, isophthalic acid, terephthalic acid, toluene dicarboxylic acid, and naphthalene dicarboxylic acid; and (4) alkyl or alkenyl succinic acids, having hydroxy carbon radicals of from 4 to 35 carbon atoms in their side chain, such as isododecenyl succinic n-dodecenyl succinic acid; and anhydrides or lower alkyl-substituted derivatives thereof. The term "lower alkyl" means linear, branched or cyclic hydrocarbon radicals having 1 to 10 carbon atoms.

Acids (1), (2) and (4) and anhydrides or lower alkyl derivatives thereof are preferred in the present invention. Maleic acid or anhydride, fumaric acid, isophthalic acid, terephthalic acid, dimethylterephthalate and n-dodecenyl succinic acid or anhydride are most preferably employed.

Maleic acid or anhydride and fumaric acid are preferred for their high reactivity. Isophthalic acid and terephthalic acid are preferred for their effect on increasing the glass transition temperature of the resin. Alkyl or alkenyl succinic acid and anhydride are preferred for improving the milling efficiency of the resin.

Suitable polycarboxylic acids having three or more carboxyl groups include (1) aliphatic tricarboxylic acids having from 7 to 20 of carbon atoms, such as 1,2,4-butane tricarboxylic acid, 1,2,5-hexane tricarboxylic acid, 1,3-dicarboxyl-2-methyl-2-methylene carboxypropane, tetra (methylenecarboxyl)methane, and 1,2,7,8-octatetracarboxylic acid; (2) cyclic polycarboxylic acids having from 9 to 20 of carbon atoms, such as 1,2,4-cyclohexane tricarboxylic acid; (3) aromatic polycarboxylic acids having from 9 to 20 of carbon atoms, such as 1,2,4-benzene tricarboxylic acid, 1,2,5-benzene tricarboxylic acid, 2,5,7-naphthalene tricarboxylic acid, 1,2,4-naphthalene tricarboxylic acid, pyromellitic acid, and benzophenone tetracarboxylic acid; and anhydrides or lower alkyl derivatives thereof.

Acids (3) and anhydrides or lower alkyl derivatives thereof are preferred. 1,2,4-Benzene tricarboxylic acid and 1,2,5-benzene tricarboxylic acid and anhydrides or lower alkyl derivatives thereof are more preferred for their low cost and hot offset resistance.

Polycarboxylic acids having three or more carboxyl groups comprise from 0 to 30 mole %, more preferably from 0 to 10 mole %, of the polyester binder resin.

In a preferred embodiment, the polyester binder resin additionally contains other polyols in addition to an oxyalkylether of a novolak phenol resin. These polyols are dihydroxylic alcohols and alcohols containing three or more hydroxyl groups.

Suitable dihydroxylic alcohol include (1) an alkylene glycol, having 2 to 12 carbon atoms, such as ethylene glycol, 1,2-propylene glycol, 1,3-propylene glycol, 1,4-butane diol, neopentyl glycol, 1,4-butene diol, 1,5-pentane diol, and 1,6-hexane diol; (2) an alkylene ether glycol, such as diethylene glycol, triethylene glycol, dipropylene glycol, polyethylene glycol, polypropylene glycol, and polytetramethylene glycol; (3) an aliphatic cyclic diol, having from 6 to 30 carbon atoms, such as 1,4-cyclohexane diol and hydrogenated bisphenol A; (4) bisphenols, such as bisphenol A, bisphenol F and bisphenol S; and (5) an adduct of a bisphenol, e.g., bisphenol A, bisphenol F or bisphenol S, with from 2 to 8 mole of alkylene oxide, such as ethylene oxide, propylene oxide, or butyrene oxide.

Compounds (1) and (5) are preferred, with compounds (5) more preferred. Ethylene glycol is preferred for its capability of increasing the reaction speed. Both 1,2-propylene glycol and neopentyl glycol are preferred for their effect on low temperature fixing. Bisphenol A derivatized with from 2 to 4 moles of ethylene oxide and/or propylene oxide is preferred for its capability of imparting excellent resistance to hot offset.

Suitable alcohols having three or more hydroxyl groups, include (1) aliphatic polyhydric alcohols having from 3 to 20 carbon atoms, such as sorbitol, 1,2,3,6-hexane tetrol, 1,4-sorbitan, pentaerythritol, dipentarythritol, tripentaerythritol, 1,2,4-butanetriol, 1,2,5-pentatriol, glycerol, 2-methylpropane triol, 2-methyl-124-butane triol, trimethylol ethane, and trimethylol propane; and (2) aromatic polyhydroxylic alcohols, having from 6 to 20 carbon atoms, such as 1,3,5-trihydroxylmethylbenzene and adducts of aromatic polyhydroxylic alcohols.

Compounds (1) are preferred among the above alcohols. Glycerol, trimethylol propane and pentaerythritol are most preferred for their low cost.

In the polyol, the ratio of oxyalkylether of a novolak phenol resin to alcohols having two hydroxyl groups to alcohols having two hydroxyl groups, is generally (2–100): (0–98): (0–20), preferably (4–70): (30–96): (0–10) and more preferably (4–50): (50–96): (0–5).

The polyester binder resin may be made by any of the well-known methods, see *Kirk-Othmer Encyclopedia of Chemical Technology*, Fourth Edition, Volume 19, Wiley-Interscience, New York, 1996, pp. 609–678, incorporated herein by reference. Preferably, the polyester resin is prepared by polymerizing one or more carboxylic acids or anhydrides with the polyol at an elevated temperature. Preferably, temperature from 50° to 200° C. are used. More preferably, the polymerization temperature is between 100° and 200° C. An acid catalyst may be used.

In one embodiment, the binder resin having a glass transition temperature of from 50° C. to 65° C., an acid value of preferably from 1 to 5 mg KOH/g, more preferably from 1 to 3 mg KOH/g, and a hydroxy radical value of preferably from 30 to 80 mg KOH/g, more preferably from 30 to 60 mg KOH/g.

The binder resin of the present invention having these properties has several advantages, such as charge stability when exposed to light and relatively fast rates of electrostatic charging. These advantages increase the image density and reduce blur in the reproduced images.

The preferable glass transition temperature of the binder resin of from 50° to 65° C. was measured by a differential scanning calorimeter (DSC) curve. For glass transition temperatures lower than 50° C., caking of the toner during storage may result and, for glass transition temperatures higher than 65° C., low temperature image fixing is difficult to achieve. In addition, a binder resin with a low image fixing temperature is generally favored. Accordingly, a lower glass transition temperature is preferred as long as the toner is properly stored before use.

In order to reduce environmental effects on toner charging, a resin that absorbs less moisture is preferred. In this respect, an oxyalkyl ether of a novolak phenol resin as the polyol component in the present invention is preferred to other polyol compounds. A moisture content of less than 5000 ppm is also achieved by using an oxyalkyl ether of a novolak phenol resin in the binder resin, resulting in excellent humidity resistance. By rendering its acid value to about 5 mg KOH/g or less and its hydroxy radical value of from 30 to 80 mg KOH/g with this resin, the amount of absorbed moisture is further reduced to less than 3000 ppm, resulting in excellent charge stability.

Although a lower acid value is preferred for the binder resin, the polymerization reaction used to prepare the polyester becomes difficult with an acid value of about 1 or less. A value of from 1 to 5 mg KOH/g is employed to obtain the moisture content of the range of about 3000 ppm or less.

A hydroxy radical value of from 30 to 80 mg KOH/g is preferred for the polymerization reaction. The esterification reaction with a hydroxy radical value of less than 30 mg KOH/g has not been demonstrated. A hydroxy radical value of from 30 to about 60 mg KOH/g can be employed to reduce the moisture content. By appropriately adjusting these two values, as mentioned above, a binder resin with a moisture content of about 3000 ppm or less can be obtained.

The moisture content in the binder resin was measured as follows. The binder resin was pulverized to the size of about 200 microns or less and placed at 30° C. and 60% humidity for 24 hours and the moisture content was measured by the Fisher method.

The binder resin is mixed with at least one coloring agent and/or magnetic material, and also a charge control agent and/or other additives, when necessary. The mixture is then fused to produce the electrostatic image developing toner.

Suitable materials for the coloring agents in the present invention include carbon black, iron oxide, phthalocyanine blue, phthalocyanine green, Rhodamine 6G Lake, and Watching Red strontium, for example. The amount of the coloring agents in the binder resin is from 1 to 60% by weight. This value is appropriately selected for the intended use.

Suitable charge control agents include nigrosine, nigrosine denatured by aliphatic acid, metal containing nigrosine, metal containing denatured nigrosine, and the chromium complex of 3,5-di-tert-butyl salicylic acid. The amount of the charge control agents in the binder resin is generally from 0 to 20% by weight.

Wax having a melting temperature of from 70° C. to 170° C. can be used as a releasing agent in the present invention toner. Suitable waxes include carnauba wax, montan wax, paraffin wax, low molecular weight polyethylene, low molecular weight polypropylene, and ethylene-vinyl acetate copolymer. The toner preferably contains from 1 to 10% by weight of wax. By including wax in the toner, hot offset resistance is generally improved. However, the solubility of the wax in the binder resin may decrease and image fixing ability generally decreases with an increasing amount of the wax. In addition, too much wax can decrease the charge and/or cause charge instability. Therefore, it is best to use a small amount of wax.

We have found that when a wax having a particle diameter of about 100 microns is prepared and mixed into the binder resin and milled with high shear, its average diameter can be reduced to about 2 microns or smaller. By including these fine wax particles in an amount of up to 10% by weight, satisfactory releasing effects are observed without any of the undesirable effects mentioned above.

Other additives may be used the toner, including silica powder, hydrophobic silica powders, polyolefins, paraffin wax, fluorocarbon compounds, aliphatic esters, partially saponified aliphatic esters and metal salts of aliphatic acids. These additives are generally included in the toner from 0.1 to 5% by weight.

The image developing toner of the present invention can be used in both a single component developer and a two component developer.

In a single component developer, a ferromagnetic material is generally incorporated into the binder resin. Examples of such ferromagnetic material include alloys and compounds, such as ferrite and magnetite, which contain ferromagnetic ion species like iron, cobalt or nickel. Also preferred are alloys and compounds, such as manganese-copper-aluminum alloy or manganese-copper-tin (Heusler's) alloy and chromium oxide, which are rendered ferromagnetic by heating.

The amount of the ferromagnetic material in the binder resin is preferably from 20 to 70% by weight, and more preferably from 40 to 70% by weight.

The ferromagnetic material is dispersed in the binder resin as fine particles together with wax. The particle diameter of the dispersed ferromagnetic material is preferably about 0.1 microns or less. When the dispersion of magnetic particles in the resin were observed with a transmission electron microscope, however, the majority of the fine particles tended to aggregate and form particles when the diameter of the ferromagnetic material was from 0.1 to 1 microns. In the present invention, the dispersion is prepared with sufficient shear to afford ferromagnetic material with a particle diameter in the range of 0.1 micron or less.

The fabrication of the image developing toners of the present invention is accomplished with conventional techniques, such as mixing and milling. The toner components, including coloring agents, binder resin and other components, when desired, are mixed and pulverized. The resulting composition is then dissolved or dispersed in an appropriate solvent, further mixed in a ball mill and then spray dried to obtain the present invention image developing toner as particles.

An image developing toner for a two-component developing toner contains a coloring agent, binder resin and a charge control agent, similar to other conventional toners.

When used for development methods such as cascade or magnetic brush, for example, the toner particles generally have an average diameter of about 30 microns or less. Best results are obtained when the average diameter is from 4 to 20 microns. For powder cloud developing, toners with diameters of slightly less than 1 micron are preferred.

Well-known conventionally coated or non-coated carrier particles are used in cascade and magnetic brush development. The coating is made with a thin insulating polymeric shell which controls the degree and sign of charge imparted to the toner. When a toner particles comes into close proximity to the surface of a carrier particle, the toner acquires a charge of opposite sign from that of the carrier. Since the carrier and toner have charges of opposite sign, they are physically bound by electrostatic attraction. Since the carrier can be made of any material, as long as the toner acquires a charge of opposite sign, the toner of the present invention can be mixed with most conventional carrier particles to form electrostatic images on a conventional photoconductor surface.

The present invention toner is preferably obtained by a manufacturing process using high shear mixing and blending.

A method of mechanically breaking or milling the tetrahydrofuran-insoluble portion of the polyester binder resin is used in preparing the present invention developing toner, which contains from 5 to 20% by weight of a microgel component. A polyester binder resin, containing from 10 to 40% by weight of the tetrahydrofuran-insoluble portion, is mixed with at least one coloring agent, e.g., carbon black, charge control agent and other materials. A vinyl resin can also be included. This mixture is then subjected to milling with mechanical shear to prepare the inventive toner containing the polyester resin essentially free of the tetrahydrofuran-insoluble portion.

In the milling process, the toner components are premixed with a V-shape blender or Henschel mixer and then milled with a heat roller, a kneader, a Bumbury's mixer, or either a one-or two-axis blending machine, at a temperature from 100° C. to 200° C. In the milling process, there exists a region of molecular weight for which molecular chain scission can be achieved. The effectiveness of the molecular chain scission depends mainly on the viscosity of the mixture during milling.

The viscosity of the mixture is preferably from $10^4$ to $10^7$ poise. When the viscosity is lower than $10^4$ poise, sufficient molecular chain scission is not achieved and a fraction of the tetrahydrofuran-insoluble portion is not reduced in molecular weight and remains in the toner. When the viscosity is greater than $10^7$ poise, the components are difficult to mix.

A high mechanical load is then exerted on the milling machine, which can possibly break the mixer.

The molecular chain scission is effective for components having a weight-average molecular weight of about $1\times10^7$ or greater. When the molecular weight distribution is measured after the milling and compared with the previous molecular weight distribution, the relative amount in the range of about $1\times10^4$ or below exhibits almost no change from the milling. This molecular chain scission is generally difficult to achieve in a polymerization reaction.

A binder resin having components of molecular weight in the range of about $1\times10^4$ or below is advantageous for hot offset resistance and filming properties. However, the components having in this molecular weight range have an adverse effect on milling and image fixing. We have found that best results are achieved when (1) the main peak of the weight average molecular weight distribution of the polyester binder resin is in the range of from 2000 to 10000, and (2) the binder resin contains components of weight-average molecular weight of about 10000 or less in an amount of from 50 to 70% by weight. The components of relatively low molecular weight are especially favored, preferably from 2000 to 10000 and more preferably from 2000 to 4000.

The polyester resin of the present invention preferably has a softening temperature of from 70° C. to 85° C. With a softening temperature of about 70° C. or less, the hot offset resistance of the toner decreases. When the softening temperature exceeds 85° C., the low temperature fixing ability of the toner decreases. In addition, as the fluidity initiation temperature is related to the softening temperature, the former is preferably from 115° C. to 135° C. in the present invention.

By satisfying the above two properties, developing toners of excellent and balanced image fixing and offset resistance can be prepared.

The softening temperature was measured with a flow tester CFT-5000 from the Shimazu Co. as follows.

The measurement conditions are selected to be a mechanical load of 10 kg/cm$^2$, nozzle diameter of 1 mm, nozzle length of 1 mm and speed of temperature increase of 10° C./min. The softening temperature, $T_s$, is calculated by the tester and $T_{ib}$, also measured by the tester, is recorded as the fluidity initiation temperature.

Having generally described this invention, a further understanding can be obtained by reference to certain specific examples which are provided herein for purposes of illustration only and are not intended to be limiting. In the description in the following examples, parts and percentage are by weight unless otherwise indicated.

EXAMPLES

Various electrostatic image developing toners were prepared in accordance with the steps of the present invention using the materials identified below.

Components and major properties of the polyester resin used to prepare the present invention toners are shown in Table 1.

TABLE 1

| Polyester resin | I | II | III | IV | V |
|---|---|---|---|---|---|
| Component A | | | | | |
| TPA | 324 | 262 | — | — | — |
| IPA | — | — | — | 226 | — |
| DMT | — | — | 312 | 246 | — |
| AA | — | — | 26 | — | — |
| FA | — | — | — | — | 298 |
| DSA | — | 89 | — | — | — |
| TMA | — | — | — | 64 | — |
| Component B | | | | | |
| Glycol A | 700 | — | 415 | 146 | 900 |
| Glycol B | — | — | — | — | — |
| Glycol C | — | 320 | — | — | — |
| Glycol D | — | — | — | 137 | — |
| EG | — | — | 31 | — | — |
| NPG | — | — | — | 264 | — |
| Crosslinking agent | | | | | |
| Oxyalkylene ether | 300 | 200 | 47 | 53 | 100 |
| (Nuclide number) | (7.2) | (5.0) | (3.2) | (3.2) | (4.1) |
| Trimethylol propane | — | — | — | — | — |
| Trimellitic anhydride | — | — | — | — | — |
| Property | | | | | |
| $T_g$ (°C.) | 60 | 56 | 61 | 55 | 57 |
| Acid value | 3.0 | 0.8 | 2.5 | 2.0 | 1.5 |
| Hydroxy radical value | 27 | 65 | 70 | 60 | 61 |
| THF insoluble (%) | 25 | 15 | 40 | 30 | 18 |
| Water content (ppm) | 5100 | 5500 | 5300 | 2500 | 2700 |

References for Table 1
(1) Glycol A: Polyoxypropylene(2,2)-2,2-bis(4-hydroxyphenyl)propane (Hydroxy radical value 315).
(2) Glycol B: Polyoxypropylene(2,3)-2,2-bis(4-hydroxyphenyl)propane (Hydroxy radical value 340).
(3) Glycol C: Polyoxyethylene-propylene-bis(4-hydroxyphenyl)methane (Hydroxy radical value 320).
(4) Glycol D: Polyoxypropylene(3,1)-2,2-bis(4-hydroxyphenyl)propane (Hydroxy radical value 275).
(5) EG: Ethylene glycol.
(6) NPG: Glycol.
(7) TPA: Terephthalic acid.
(8) IPA: Isophthalic acid.
(9) FA: Fumaric acid.
(10) AA: Adipic acid.
(11) DMT: Dimethyl terephthalate.
(12) DSA: Dodecenyl anhydride.
(13) TMA: Trimellitic anhydride.

Measurement methods for properties of the present invention polyester resin.

1. Acid value and hydroxy radical value were measured according to the method defined by JIS K0070, incorporated herein by reference. When the toner sample did not dissolve, a solvent such as dioxane or tetrahydrofuran was used. 2. Glass transition temperature ($T_g$) was measured according to the DSC method defined by ASTM D3418-82, incorporated herein by reference.

EXAMPLES A-1 THROUGH A-4 AND COMPARATIVE EXAMPLE A1

Electrostatic image developing toners of the present invention were fabricated by mixing, melting and milling with a two-roller kneader, the following components. Milling conditions are shown in Table 2.

Polyester resin 3000

Carbon black (#40 from Mitsui Chemical Co.) 20

Oil Black BY (Orient Chemical Co.) 250

Shown in Tables 2 through 4 are the fractional values of microgel included in the binder resin, which contains components having molecular weight of greater than $1\times10^7$ found in a tetrahydrofuran solution of the toner, after removing the insoluble material from the solution.

Various evaluation tests and measurements for the inventive toners were carried out as follows.

Image Quality

The following components were thoroughly mixed to obtain image developing toners of the present invention.

Toner (as sorted particles, having the diameter of from 10 to 11 microns) 50

Iron Oxide EFV 200/300 (Nihon Teppun Co.) 950

Photocopies were produced utilizing these toners with a Ricoh Co. high speed copy apparatus commercially available as FT 8200™. The photocopies were then subjected to the image quality test.

Lowest Fixing Temperature

During a photocopying process with the present invention toners, unfinished or prefixed copies were intentionally prepared by removing the fixing unit from the photocopying apparatus. The prefixed copies were then fed through a fixing roller assembly which was separately provided in order to change the fixing temperature in the test. By changing the temperature, and by rubbing the surface of the copies with a cotton cloth, the lowest temperature was found, at which the cotton cloth did not collect toner particles from the photocopy. This temperature is shown as the lowest fixing temperature in the Tables.

Hot Offset Temperature

During a photocopying process with the present invention toners, a white paper was intentionally photocopied to receive toner particles offset on the heat rollers of the apparatus.

The hot offset temperature was found as the highest temperature at which toner particles were not observed on the finished photocopy sheet.

Charge Stability

The amount of the electrostatic charge, acquired by corona charging, on the inventive toners was measured under the conditions of high temperature and high humidity (30° C. and 90%) and low temperature and low humidity (10° C. and 30%).

The amount of charge observed under these conditions and differences between these two conditions were examined.

Milling Efficiency

Following toner milling, the toners were crushed with a hammer mill and finely pulverized with an air mill. During the pulverizing step, the rate of toner feeding required to obtain an average toner particle diameter of 10 microns was measured as a milling efficiency parameter. Outpouring pressure for the air mill during the milling process was set at 5.0 kg/cm$^2$.

TABLE 2

| | Example | | | | Comparative Example |
|---|---|---|---|---|---|
| | A-1 | A-2 | A-3 | A-4 | A1 |
| Polyester resin | I | II | III | IV | I |
| Milling condition | | | | | |
| Temperature (°C.) | 130 | 140 | 130 | 130 | 160 |
| Time (hour) | 30 | 30 | 20 | 40 | 20 |
| Milling property of toner | | | | | |
| Main peak of MW | 8000 | 6000 | 5000 | 3000 | 8000 |
| Fraction of $10^4$ or less of MW (%) | 47 | 65 | 60 | 70 | 45 |
| THF insoluble (%) | 0 | 0 | 0 | 0 | 0 |
| Microgel (%) | 10 | 15 | 10 | 5 | 30 |
| Softening temperature (°C.) | 68 | 65 | 78 | 72 | 80 |
| Fluidity initiation Temperature (°C.) | 125 | 125 | 137 | 121 | 140 |
| Toner quality | | | | | |
| Lowest fixing temperature (°C.) | 130 | 135 | 130 | 130 | 155 |
| Hot offset temperature (°C.) | 240 | 255 | 250 | 240 | 240 |
| Charge stability | ○ | ○ | ○ | ○ | Δ |
| Milling efficiency (kg/hour) | 20 | 22 | 23 | 25 | 17 |

○: Satisfactory, and Δ: Unsatisfactory

Comparative Example A1 in Table 2 shows a higher amount of microgel fraction, higher fixing temperature, and lower milling efficiency, compared with values for Examples A-1, A-2, A-3 and A-4. These toner characteristics are unfavorable.

The results with Examples A-1 through A-4 indicate that the low temperature fixing, hot offset resistance, milling efficiency, and charge stability are well balanced and satisfactory for each of these toners.

EXAMPLES A-5 THROUGH A-8 AND COMPARATIVE EXAMPLE A2

Electrostatic image developing toners of the present invention were fabricated using the polyester resins I through V in Table 1 in a similar manner to Example 1, with the exception that wax was additionally provided in an amount of 5 parts by weight. The toner of Comparable Example A1 included wax with a particle diameter of over 2 microns. This toner also contained the tetrahydrofuran-insoluble portion of the polyester binder resin. The results of the evaluation tests are shown in Table 3.

TABLE 3

| | Example | | | | Comparative Example |
|---|---|---|---|---|---|
| | A-5 | A-6 | A-7 | A-8 | A2 |
| Polyester resin | I | II | III | IV | II |
| Milling condition | | | | | |
| Temperature (°C.) | 130 | 140 | 130 | 130 | 170 |
| Time (hour) | 30 | 30 | 40 | 40 | 30 |
| Milling property of toner | | | | | |

TABLE 3-continued

| | Example | | | | Comparative Example |
|---|---|---|---|---|---|
| | A-5 | A-6 | A-7 | A-8 | A2 |
| Main peak of MW | 8500 | 7000 | 6000 | 3500 | 12000 |
| Fraction of $10^4$ or less of MW (%) | 72 | 50 | 55 | 65 | 40 |
| THF insoluble (%) | 0 | 0 | 0 | 0 | 15 |
| Microgel (%) | 5 | 10 | 10 | 15 | 10 |
| Softening temperature (°C.) | 67 | 75 | 68 | 85 | 30 |
| Fluidity initiation Temperature (°C.) | 120 | 138 | 125 | 130 | 140 |
| Wax particle diameter (micron) | 1.2 | 0.8 | 0.5 | 1.5 | 2.5 |
| Toner quality | | | | | |
| Lowest fixing temperature (°C.) | 125 | 125 | 122 | 130 | 145 |
| Hot offset temperature (°C.) | 250 | 250 | 250 | 260 | 260 |
| Charge stability | o | o | o | o | o |
| Milling efficiency (kg/hour) | 25 | 22 | 20 | 18 | 5 |
| Spent carrier | none | none | none | none | a few |
| Wax | | | | | |
| Wax | CW | PE | PE | PP | PE |
| Softening Temperature (°C.) | 87 | 105 | 110 | 155 | 105 |

CW: Carnauba wax, PE: Polyethylene, PP: Polypropylene.

The results in Table 3 for Examples A-5 through A-8, which include wax, indicate that hot offset temperatures are higher by from 5° C. to 20° C. compared with those of Examples A-1 through A-4 in Table 2, which did not include wax.

The results in Table 3 also indicate that spent carrier resistance decreases with increasing diameter of the wax particles, and that an increase in the fixing temperature and a decrease in the milling efficiency are observed with the inclusion of the tetrahydrofuran-insoluble portion of the binder resin.

EXAMPLES B-1 THROUGH B-4 AND COMPARATIVE EXAMPLES B1 AND B2

Electrostatic image developing toner of the present invention were fabricated using the polyester resins I through IV and the following components by mixing, melting and milling with a two-roller kneader. Milling conditions are shown in Table 4.

Polyester resin 1500
Oil Black BY (Orient Chemical Co) 250
Magnetite 1500

The evaluation tests and various measurements for the resulting toners were carried out for cleaning efficiency and image density, in addition to the properties which were measured for Examples A-1 through A-4 and Comparative Examples A1 and A2.

Cleaning Efficiency

Immediately after the blade cleaning step of the photocopying process, the surface of the photoreceptor of the copying apparatus was visually observed, in order to determine if there was any toner material remaining due to insufficient cleaning. These results are also shown in Table 4 as follows:

O: Satisfactory and acceptable (none or few toner particles were observed).
Δ: acceptable (few toner particles were observed).
X: Not acceptable (many toner particles were observed).

Image Density

The optical density of photocopied images made with the developing toner of the present invention was examined after two hundred thousand copying cycles with a McBeth densitometer. The optical density of the images were measured relative to 0.0 density of a white paper sheet background. The acceptable optical density was greater than or equal to 0.8.

TABLE 4

| | Example | | | | Comparative Example | |
|---|---|---|---|---|---|---|
| | B-1 | B-2 | B-3 | B-4 | B1 | B2 |
| Polyester resin | I | II | III | IV | I | II |
| Milling condition | | | | | | |
| Temperature (°C.) | 130 | 140 | 130 | 130 | 160 | 130 |
| Time (hour) | 20 | 20 | 15 | 50 | 20 | 20 |
| Milling property of toner | | | | | | |
| Main peak of MW | 7500 | 3000 | 4000 | 3000 | 5000 | 4500 |
| Fraction of $10^4$ or less of MW (%) | 45 | 55 | 50 | 60 | 45 | 50 |
| THF insoluble (%) | 0 | 0 | 0 | 0 | 0 | 15 |
| Microgel (%) | 5 | 15 | 10 | 5 | 15 | 25 |
| Softening temperature (°C.) | 66 | 68 | 87 | 73 | 75 | 85 |
| Fluidity initiation Temperature (°C.) | 125 | 125 | 125 | 120 | 145 | 140 |
| Magnetic material size (micron) | ≦0.1 | ≦0.1 | ≦0.1 | ≦0.1 | 0.6 | 0.4 |
| Quality | | | | | | |
| Lowest fixing temperature (°C.) | 125 | 125 | 130 | 130 | 155 | 160 |
| Hot offset temperature (°C.) | 240 | 250 | 130 | 130 | 155 | 160 |
| Cleaning efficiency | o | o | o | o | X | X |
| Image density | Good | Good | Good | Good | Fair | Bad |
| Milling efficiency (kg/hour) | 30 | 35 | 32 | 35 | 13 | 20 |

For Examples A-1 through A-4, which contain no magnetic material, the cleaning efficiency was acceptable (Δ).

The results in Table 4 indicate that Comparative Example B1, which contains magnetic material of larger particle diameter and includes a greater amount of microgel portion, and Comparative Example B2, which contains a tetrahydrofuran-insoluble portion, are inferior to Examples B-1 through B-4 in terms of low temperature fixing, milling efficiency and cleaning efficiency. In contrast, the results in Table 4 indicate that the above-mentioned properties are satisfactory and well-balanced for Examples B-1 through B-4.

This application is based on Japanese Patent Applications 07-239237 and 08-020563, filed with the Japanese Patent Office on Aug. 24, 1995 and Jan. 11, 1996, respectively, the entire contents of which are hereby incorporated by reference.

Obviously, additional modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. An electrostatic image developing toner, comprising:

a polyester binder resin comprising at least one polyol crosslinked with at least one polycarboxyl group, wherein at least one of said polyol is an oxyalkylether of a novolak phenol resin; and said polyester binder resin contains 5 to 20% by weight of components having a weight-average molecular weight greater than about $1\times10^7$ and is essentially free of a tetrahydrofuran-insoluble portion.

2. The electrostatic image developing toner of claim 1, which further contains at least one coloring agent dispersed in said polyester binder resin.

3. The electrostatic image developing toner of claim 1, wherein said polyester binder resin has a main peak of weight-average molecular weight distribution of from 2000 to 10000, and contains from 50 to 70% by weight of components having a weight-average molecular weight up to about 10000.

4. The electrostatic image developing toner of claim 1, wherein said polyester binder resin has a glass transition temperature of from 50° C. to 65° C., an acid value of from 1 to 5 mg KOH/g, and a hydroxy radical value of from 30 to 80 mg KOH/g.

5. The electrostatic image developing toner of claim 1, wherein said polyester binder resin has a water content of about 5000 ppm or less after 24 hours at a temperature of 30° C. and 60% humidity.

6. The electrostatic image developing toner of claim 1, which additionally contains at least one wax dispersed in said toner as particles having a diameter up to about 2 microns.

7. The electrostatic image developing toner of claim 1, which further contains magnetic particles having a diameter of at most 0.1 microns.

8. The electrostatic image developing toner of claim 1, wherein said toner has a softening temperature of from 70° C. to 85° C. and a lowest fluidity temperature of from 115° C. to 135° C.

9. The electrostatic image developing toner of claim 1, wherein said oxyalkylether of a novolak phenol resin is selected from the group consisting of polyoxypropylene(2,2)-2,2-bis(4-hydroxyphenyl)propane, polyoxypropylene(2,3)-2,2-bis(4-hydroxyphenyl)propane, polyoxyethylene-propylene-bis(4-hydroxyphenyl)methane and polyoxypropylene(3,1) -2,2-bis(4-hydroxyphenyl)propane.

10. The electrostatic image developing toner of claim 1, wherein said polyester binder resin is made by a process comprising the step of polymerizing at least one polycarboxylic acid or polycarboxylic anhydride with said polyol under conditions suitable for polymerization.

11. The electrostatic image developing toner of claim 1, which further contains at least one coloring agent, wherein said polyester binder resin and said coloring agent form particles.

12. The electrostatic image developing toner of claim 1, wherein said polyester binder resin has a glass transition temperature of from 50° to 65° C.

13. The electrostatic image developing toner of claim 1, wherein said polyester binder resin has a water content of about 3000 ppm or less after 24 hours at a temperature of 30° C. and 60% humidity.

14. The electrostatic image developing toner of claim 1, wherein said toner has a softening temperature of from 70° C. to 85° C.

15. The electrostatic image developing toner of claim 1, wherein said toner has a lowest fluidity temperature of from 115° C. to 135° C.

16. A method for preparing an electrostatic image developing toner, comprising the step of:

forming toner particles comprising a polyester binder resin and at least one coloring agent, wherein said polyester binder resin contains at least one oxyalkylether of a novolak phenol resin crosslinked with at least one polycarboxyl group; contains 5 to 20% by weight of components having a weight-average molecular weight greater than about $1\times10^7$; and is essentially free of a tetrahydrofuran-soluble portion.

17. The method of claim 16, wherein said polyester binder resin has a main peak of weight-average molecular weight distribution of from 2000 to 10000, and contains from 50 to 70% by weight of components having a weight-average molecular weight up to about 10000.

18. The method of claim 16, wherein said polyester binder resin has a glass transition temperature of from 50° C. to 65° C., an acid value of from 1 to 5 mg KOH/g, and a hydroxy radical value of from 30 to 80 mg KOH/g.

19. The method of claim 16, wherein said polyester binder resin has a water content of about 5000 ppm or less after 24 hours at a temperature of 30° C. and 60% humidity.

20. The method of claim 16, wherein said toner has a softening temperature of from 70° C. to 85° C. and a lowest fluidity temperature of from 115° C. to 135° C.

* * * * *